US005765419A

United States Patent [19]

Krapfenbauer

[11] Patent Number: 5,765,419

[45] Date of Patent: Jun. 16, 1998

[54] METHOD AND APPARATUS FOR A ROLLING OF HOLLOW ARTICLES

[75] Inventor: Hans Krapfenbauer, Kusnacht, Austria

[73] Assignee: Ernst Grob AG, Mannedorf, Switzerland

[21] Appl. No.: 769,847

[22] Filed: Dec. 19, 1996

Related U.S. Application Data

[63] Continuation-in-part of Ser. No. 474,668, Jun. 7, 1995, abandoned.

[30] Foreign Application Priority Data

Jun. 25, 1994 [EP] European Pat. Off. ..... 94109860

[51] Int. Cl.[6] ..... B21D 31/06

[52] U.S. Cl. ..... 72/96; 72/191; 72/193

[58] Field of Search ..... 72/76, 96, 100, 72/104, 191, 207

[56] References Cited

U.S. PATENT DOCUMENTS

| | | | |
|---|---|---|---|
| 2,565,623 | 8/1951 | Parker | 72/100 |
| 3,514,985 | 6/1970 | Marcovitch | 72/100 |
| 3,566,651 | 3/1971 | Tlaker | 72/76 |
| 3,866,450 | 2/1975 | Marciniak et al. | 72/76 |
| 4,050,276 | 9/1977 | Habegger | 72/104 |
| 4,838,066 | 6/1989 | Marcon et al. | 72/76 |

FOREIGN PATENT DOCUMENTS

| | | | |
|---|---|---|---|
| 271545 | 5/1970 | U.S.S.R. | 72/76 |

*Primary Examiner*—Lowell A. Larson
*Attorney, Agent, or Firm*—Laurence R. Brown

[57] ABSTRACT

In an impact rolling apparatus the axes of roller heads are arranged substantially perpendicularly relative to the longitudinal axis of the workpiece. Accordingly, a displacing of the material at the workpiece proceeds predominantly tangentially perpendicularly to the longitudinal axis of the workpiece, caused by the impact effect of the impact rollers mounted at the roller heads. By this arrangement of the roller heads impact rolling operations can be performed close to a shoulder of the workpiece and marked steps thus maintaining the advantages over the known impact rolling method at which the displacement of the material proceeds predominantly in the direction of the longitudinal axis of the workpiece.

13 Claims, 1 Drawing Sheet

METHOD AND APPARATUS FOR A ROLLING OF HOLLOW ARTICLES

This is a continuation-in-part of my application Ser. No. 08/474,668 of the same title, filed Jun. 7, 1995, now abandoned.

BACKGROUND OF THE INVENTION

1. Field of the Invention

The present invention relates to a method of impact rolling of hollow cylinder shaped workpieces which are subjected to a feeding along their longitudinal axis with a gear-tooth shaped die being inserted within the hollow workpieces, whereby an impact roller supported to be driven in a rotating roller head from the outside of the hollow workpieces when the workpiece is not being longitudinally fed performs individual impact like rolling operations in a sequence only on the radial positions of the grooves of the gear-tooth shaped die and wherein said individual rolling operations are performed in a direction lateral relative to said longitudinal axis.

2. Description of the Prior Art

Regarding the rolling and pressing of hollow articles having at least in part an inner thread or toothing, resp., whereby the operation proceeds from a disk, a can shaped precursor or a tube shaped body, substantially two cold shaping methods have become known.

At the one side, the pressing rolling operation is known (e.g. DE 4218092) in which in contrast to the pure pressing the wall thickness of the workpiece is reduced in a predetermined manner simultaneously with a changing of its shape. The pressing and the rolling is thereby performed by a roller which is pressed onto the workpiece and causes the deformation. The roller contacts thereby the workpiece continuously. Because the pressing force of the roller acts accordingly practically statically onto the workpiece, correspondingly large forces are needed which leads to correspondingly heavily dimensioned machines of a quite intrinsic design if the workpieces produced by same are to meet the demands posed on these workpieces.

A further cold forming method which obviates specifically these drawbacks is the impact rolling, also known as coarse-method (e.g. CH 658006). By this method, contrary to the above described method, the force is not applied statically onto the workpiece but rather dynamically in form of impacts. For this task rollers are foreseen on a rotating roller head which perform in a rapid succession impact like individual or single, resp. rolling operations onto the surface of the workpiece. These individual rolling operations are performed predominantly in the longitudinal direction of the workpiece, i.e. predominantly in the direction of the axis of the workpiece. This allows at the one side to keep the forces lower than in case of the above mentioned pressing rolling procedure and at the other hand the machines for achieving a high precision of the workpiece can also be dimensioned with less weight. However, due to the described direction of the rolling at the coarse-method there exists now the drawback that due to the arrangement of the roller head in order to work the workpiece in axial direction a free space for the planetary movement of the individual rollers is needed. Therefore, the method can not be applied if for instance a workpiece having a circumferentially extending projecting shoulder or with pronounced steps must be worked.

SUMMARY OF THE INVENTION

Therefore, it is a general object of the invention to provide a method which is analogue to the described coarse-method and is also suitable for workpieces having a circumferentially extending shoulder.

A further object is to provide a method of impact rolling of hollow cylinder shaped workpieces which are subjected to a feeding along their longitudinal axis with a gear-tooth shaped die being inserted within the hollow workpieces, whereby an impact roller supported to be driven in a rotating roller head from the outside of the hollow workpieces when the workpiece is not being longitudinally fed performs individual impact like rolling operations in a sequence only on the radial positions of the grooves of the gear-tooth shaped die and wherein said individual rolling operations are performed in a direction lateral relative to said longitudinal axis.

Still a further object is to provide an apparatus for practicing the method of the invention, comprising at least one roller head with impact rollers arranged as a roller head along a circumferential circular path whereby the axis of rotation of said roller head is arranged substantially parallel to the longitudinal axis of the workpiece.

It has been recognized that by the changing of the direction of the impact of the rollers in the radial circumferential direction of the workpiece the known advantages of the impacting method can be kept, by arranging the axis of the roller head substantially parallel to the axis of the workpiece. Thus, the space for the planetary movement of the impact rollers is no longer required in an axis-parallel direction such that the impact rolling operation can be performed up close to an outwards projecting shoulder of the workpiece. Accordingly, it is now advantageously possible to work such workpieces by the impact rolling operation.

The method can be applied at workpieces which are symmetrical with respect to rotation in that the workpiece is preferably rotated around its longitudinal axis. It is, however, also conceivable to apply the method at other workpieces at which the impact rolling operation must not be performed on the entire circumference, for instance, when producing segment-like flattened workpieces.

The inventive method is specifically suitable for hollow bodies having at least in part an inner thread.

BRIEF DESCRIPTION OF THE DRAWINGS

The present invention will be better understood and objects other than those set forth above will become apparent when consideration is given to the following detailed description thereof when read in conjunction with the appended drawings, in which.

DETAILED DESCRIPTION OF THE PREFERRED EMBODIMENT

Figure 1:
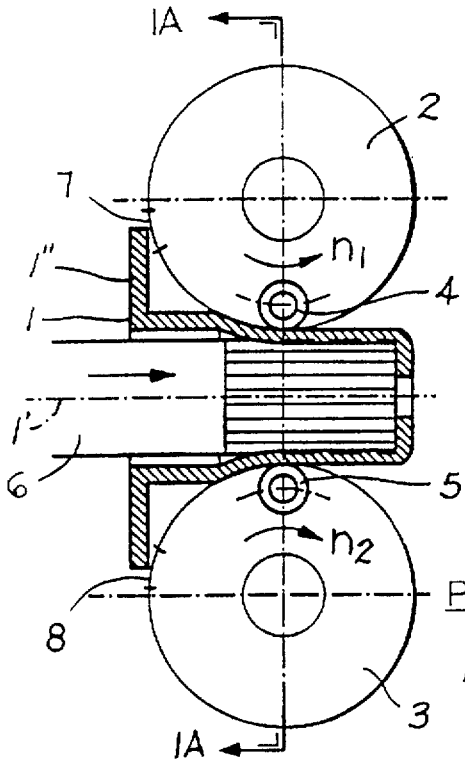
PRIOR ART FIG. 1
FIGS. 1 and 1A are schematic longitudinal and cross-section views through a known impact rolling apparatus.
Figure 1A:
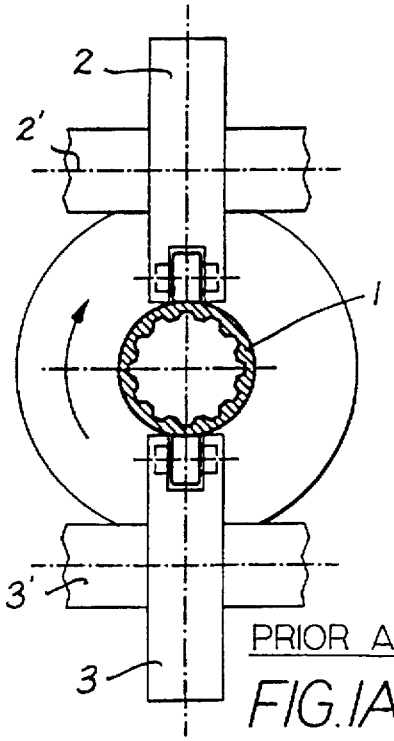
PRIOR ART FIG. 1A

FIG. 1 illustrates schematically the longitudinal and cross-section of a known impact rolling apparatus at the area of the rolling process proper. A hollow cylinder shaped workpiece 1 is fed by a not illustrated apparatus towards the area of the roller heads 2 and 3. The impact rollers 4 and 5 mounted to the roller heads 2 and 3, resp. perform during the rotation of the roller heads impact like individual rolling operations onto the surface of the workpiece 1. The material of the workpiece 1 is thereby cold - worked, for instance the inner side of the workpiece 1 attains the contour of a die 6 located at is inside. It is, thereby, possible to produce inner threads of hollow bodies speedy and with a high precision. The method can also be applied for the reduction of the cross-section of the workpiece 1, whereby the material flows predominantly in the longitudinal direction.

Usually a plurality of impact rollers 4 and 5, resp. are mounted onto a roller head 2 and 3, resp. in order to achieve a fast sequence of individual inward rolling operations at medium rotational speeds.

As the known method and corresponding apparatuses, resp. the axes 2' and 3', resp. of the roller heads 2, 3 are arranged substantially perpendicularly to the longitudinal axis 1' of the workpiece. Therewith, an impact action directed substantially parallel to the longitudinal axis 1' shall be arrived at. This incorporates now the drawback that the impact rolling operation, specifically at a workpiece having a shoulder 1", cannot be performed closely up to the area of the shoulder 1".

The workpiece 1 can be fed only so far in the direction of the arrow V until the shoulder 1" reaches the area 7 and 8 of the circulating impact rollers 4 and 5, resp.

Figure 2:
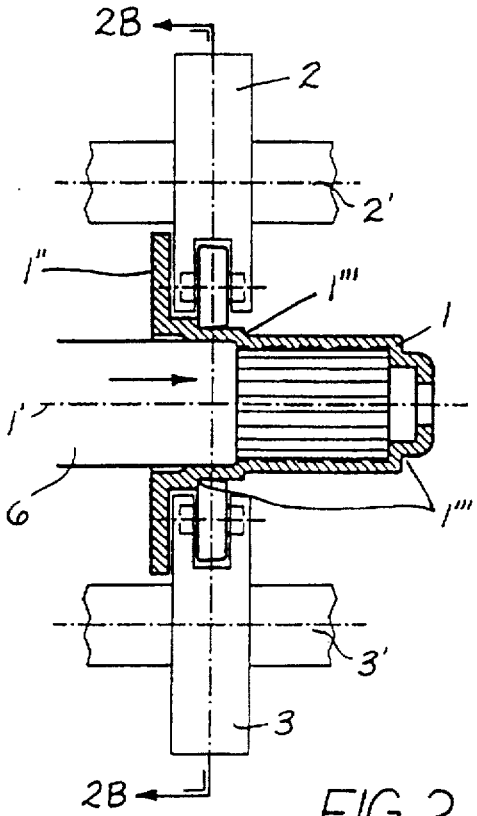
FIGS. 2 and 2B are schematic longitudinal and cross-section views through an impact rolling apparatus structured in accordance with the present invention.

In order now to be able to perform at a workpiece 1 with a shoulder 1", an impact rolling operation up close to this shoulder 1", the axes 2' and 3' of the roller heads 2 and 3 are arranged in accordance with the invention parallel to the longitudinal axis 1' such as illustrated in FIG. 2.

Thus, the workpiece can now be brought in the direction of the arrow V substantially closer to the roller heads than in case of the known method and the known apparatuses, resp. It has surprisingly been seen that the rolling operations performed now perpendicularly to the longitudinal axis' of the workpiece are suitable for a cold forming in the same way as the known rolling operations performed parallel to the longitudinal axis' of the workpiece.

Finally, it is quite advantageous that both roller heads 2 and 3 which are located diametrically oppositely of each other are now driven in the same sense of rotation $n_1$ and $n_2$. At the one side this leads to a equal loading acting onto the longitudinal axis 1' of the workpiece in that the parallel components of the oppositely directed force or impact, resp. vectors $S_1$ and $S_2$ neutralize each other and only the resulting torque must be taken up by the workpiece 1. At the other side, the drive of the two roller heads 2 and 3 is also simplified, which heads must be coupled to each other in synchronism in order to have the respective two opposite impact rollers 4 and 5 coming at the same time to act onto the workpiece 1. This can now proceed for instance by a simple toothed belt.

The inventive method is specifically suitable for the production of inner toothings at hollow workpieces. Thereby, the speed of rotation of the roller heads is advantageously adjusted relative to the feed of the workpiece in such a manner that only exactly those impact rolling operations are applied onto the inner surface of the workpiece which are necessary for the forming of the inner toothing.

Figure 2B:
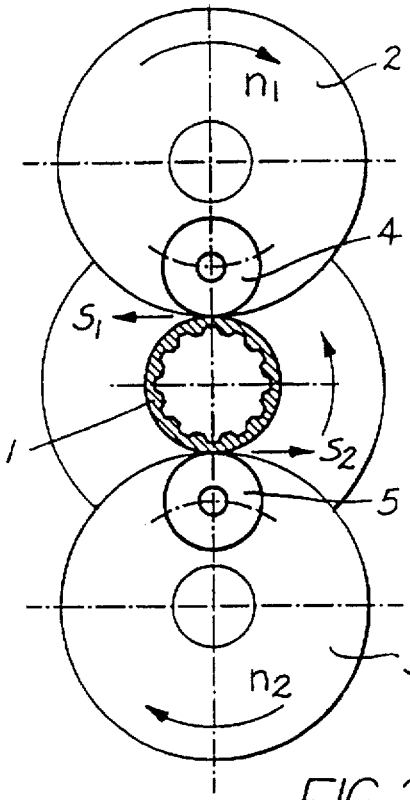

Therefore it is provided that the impact rolling operation only takes place on the radial positions of the grooves 6' of the die 6, as shown in FIG. 2B. The synchronization of the rotation of the die 6 together with the workpiece 1 in respect to the roller heads, 2 and 3 now can be easily performed by known step-by-step rotating driving of the die 6.

While there is shown and described a present preferred embodiment of the invention, it shall distinctly be understood that the invention is not limited thereto, but may be otherwise variously embodied and practiced within the scope of the following claims.

We claim:

1. A method of impact rolling of hollow cylinder shaped workpieces which are subjected to a feeding along their longitudinal axis with a shaped die being inserted within the hollow workpieces, whereby an impact roller supported to be driven in a rotating roller head from outside of the hollow workpieces when the workpiece is not being longitudinally fed performs individual impact like rolling operations in a sequence only on radial positions of the shaped die synchronously with the rotation of the rotating roller head and wherein said individual rolling operations are performed step-by-step at different locations in a longitudinal direction relative to said longitudinal axis.

2. The method of claim 1, wherein said radial positions onto which said individual rolling operations are performed overlap each other partly.

3. The method of claim 1, wherein the impact roller has two roller heads arranged diametrically opposite to perform two rolling operations simultaneously at diametrically opposite sides of the workpiece.

4. The method of claim 1, wherein the impact roller has a plurality of roller heads, and wherein all roller heads are driven in the same sense of rotation, such that the vectors of the impact of the rollers onto the surface of the workpiece have the same sense of rotation relative to the longitudinal axis of the workpiece.

5. The method of claim 1, wherein the workpiece is rotated around its longitudinal axis during the rolling operation synchronously with the rotation of the roller head.

6. An apparatus for practicing the method of claim 1, comprising at least one roller head with impact rollers arranged on the roller head for impact with the workpieces along a circumferential circular path whereby the axis of rotation of said roller head is arranged substantially parallel to the longitudinal axis of the workpiece.

7. The apparatus of claim 6, comprising an impact roller with two or more roller heads in a diametrically balanced arrangement rotated in a sense which causes a balance of impact forces exerted onto the workpiece.

8. The method of claim 1 further comprising the step of performing individual rolling operations upon the workpieces to provide at least one pronounced projecting shoulder step along the longitudinal axis of the workpieces.

9. The method of claim 1 further comprising the additional step of providing workpieces for reduction of cross section by flowing material predominately in the longitudinal axis direction of the workpiece.

10. The method of claim 1 further comprising the additional step of providing a grooved gear tooth shaped die within the hollow workpiece.

11. The method of claim 10, wherein a plurality of said impact like rolling operations are performed at groove locations about a periphery of the workpiece, whereby the impact roller has two roller heads arranged diametrically opposite and are driven in the same sense of rotation to achieve an equilibrium of the rolling forces.

12. The method of claim 11 further comprising the step of rotating the workpiece synchronously to present grooves of the die for rolling by said roller head in a step-to-step rotating mode of rotation of the workpiece and internal die.

13. The method of claim 1 further comprising the steps of providing cup-like workpieces with a flange like shoulder radially extending from an outer cylindrical surface to be rolled, and rolling said outer cylindrical surface with said rotating roller head closely adjacent to said shoulder.

* * * * *